US006517683B2

(12) United States Patent
Brox

(10) Patent No.: US 6,517,683 B2
(45) Date of Patent: Feb. 11, 2003

(54) SHOE PRESS WITH MOVABLE GUIDES TO ALTER MACHINE DIRECTION SHOE POSITION

(75) Inventor: Erik Brox, Karlstad (SE)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 09/866,982

(22) Filed: May 29, 2001

(65) Prior Publication Data

US 2002/0060044 A1 May 23, 2002

Related U.S. Application Data

(60) Provisional application No. 60/214,959, filed on Jun. 29, 2000.

(51) Int. Cl.[7] ..... D21F 3/02

(52) U.S. Cl. ..... 162/205; 162/358.3; 162/361; 100/153

(58) Field of Search ..... 162/358.3, 361, 162/205, 199; 100/153

(56) References Cited

U.S. PATENT DOCUMENTS 4,705,602 A * 11/1987 Dahl ..... 162/358.3
4,973,384 A * 11/1990 Crouse et al. ..... 162/358.3
5,662,777 A * 9/1997 Schiel et al. ..... 162/358.3
5,676,799 A * 10/1997 Meschenmoser et al. 162/358.3
5,753,084 A * 5/1998 Bubik et al. ..... 162/358.3
6,042,694 A * 3/2000 Brox ..... 162/358.3

* cited by examiner

*Primary Examiner*—Karen M. Hastings
(74) *Attorney, Agent, or Firm*—Alston & Bird LLP

(57) ABSTRACT

The invention relates to a press in a machine for the production or treatment of a continuously running web of cellulosic fibrous material, for instance a paper, tissue or board machine. The press includes a press device and a counter element arranged opposite the press device, which is arranged to form a press zone in the form of an extended press nip in cooperation with the press device having a certain width in the machine direction for pressing the fibrous web as it runs through the press nip. The press device also includes a press shoe, a support element for supporting and pressing the press shoe in a direction towards the counter element via at least one power device arranged between the press shoe and the support element for application of a certain pressure onto the fibrous web during the pressing operation, a flexible and preferably impermeable belt that is arranged to run in a continuous loop around the support element and through the press nip, having a sliding contact with the press shoe and a first guide for the press shoe arranged downstream of the press shoe. The first guide is movable between at least a first and a second position, and the press device further includes a second guide for the press shoe arranged substantially upstream of the press shoe or at least is functioning from the upstream side of the press shoe and substantially in the machine direction and which second guide is movable between at least a first and a second position.

27 Claims, 9 Drawing Sheets

SHOE PRESS WITH MOVABLE GUIDES TO ALTER MACHINE DIRECTION SHOE POSITION

CROSS-REFERENCE TO RELATED APPLICATION

The present application claims the benefit of the filing date of U.S. Provisional Patent Application No. 60/214,959 filed Jun. 29, 2000, which is incorporated herein by reference.

FIELD OF THE INVENTION

The present invention relates to a press in a machine for production or treatment of a continuously running web of cellulosic fibrous material, for instance a paper, tissue or board machine, which press comprises a press device and a counter element arranged opposite the press device, which is arranged to form a press zone in the form of an extended press nip in cooperation with the press device having a certain width in the machine direction W for pressing the fibrous web as it runs through the press nip, which press device comprises

- a press shoe;
- a support element for supporting and pressing the press shoe in direction towards the counter element via
- at least one power device arranged between the press shoe and the support element for application of a certain pressure onto the fibrous web at the pressing operation;
- a flexible and preferably impermeable belt that is arranged to run in a continuous loop around the support element and through the press nip having a sliding contact with the press shoe; and
- a first guide for the press shoe arranged downstream of the press shoe, which first guide is movable between at least a first and a second position.

The present invention also relates to a method for altering the pressure profile in a press in a machine in which a continuously running web of cellulosic fibrous material is produced or is treated, for instance a paper, tissue or board machine, which press comprises a press device and a counter element arranged opposite the press device, which forms a press zone in the form of an extended press nip in cooperation with the press device having a certain width in the machine direction W so that a pressing of the fibrous web occurs during the passage through the press nip, which press device comprises

- a press shoe;
- a support element that supports and press the press shoe in direction towards the counter element via
- at least one power device which is arranged between the press shoe and the support element and which power device is applying a certain pressure onto the fibrous web during the pressing operation;
- a flexible and preferably impermeable belt that runs in a continuous loop around the support element and through the press nip having a sliding contact with the press shoe, and a first guide for the press shoe arranged downstream of the press shoe and which first guide is transferred by dismounting and/or adjustment between at least a first and a second position.

BACKGROUND OF THE INVENTION

Presses of above specified type are known in different designs and have since long ago been used in production of different paper and cardboard grades, especially for wet pressing with the intention to raise the dry solids content of the fibrous web, but may also be used for calendering with the intention to improve surface properties or other physical properties of the web. Typically for presses that comprise press devices having an extended press nip and which presses and press devices usually are named shoe presses and shoe press rolls respectively, is that they provide a plurality of advantages through their longer press nips compared with presses having a conventional press nip. The expression "a conventional press nip" implies in this context, a press nip in which two rigid rolls, having cylindrical cross-section, are cooperating with each other under pressure. However, the dwell time for the fibrous web in this type of press nip is only some few milliseconds because of the short press nip. In a shoe press, wherein the press nip normally is extended to approximately 20 to 30 cm, the dwell time, during which the wet fibrous web is exposed to a pressure, is considerably longer, which results in much higher water flows from the web. Additional advantages, which are achieved in comparison with presses having a conventional press nip and in which, also unlike shoe presses, an effective nip pressure can be obtained only in the press direction, are a higher dry solids content of the web at the same nip pressure, or a more lenient pressing for the web at a lower nip pressure with maintained dry solids content of the web. The latter is especially essential in the manufacture of tissue where a high pressure results in unwanted tissue properties. In the case of production of tissue, which has a low basis weight and which is used for production of household paper, for instance paper towels and other hygiene products, it is important that the bulk, i.e. the relationship between the volume and the weight of the paper, is high because high bulk paper has a desirable combination of softness and high absorption power.

However, it is also of great importance for the final properties of the fibrous web in question that the pressure in the nip is not just regulated in the press direction but also that the nip pressure in the machine direction and across this may be distributed in a suitable way within the press zone between the press shoe and the counter element, i.e. that a certain and defined pressure profile is maintained in every longitudinal section and cross-section within said press zone.

It is known, for instance through the American patent U.S. Pat. No. 4,713,147, see the FIGS. 2, 5 and 6, to successively arrange several independently working arrangements of power devices in the machine direction between the press shoe and a fixed support element for these power devices to try to achieve a suitable distribution of pressure within the press zone between the press shoe and the counter element for the fibrous web in question. Each individual power device arrangement extends across the fibrous web and is thereby so arranged that it is working in the press direction towards the press shoe and thereby also towards the counter element having the fibrous web pressed there between. Then, by varying the pressure from each power device relative to the other power devices, seen in the machine direction, the position for the common pressure resultant force is transferred towards the press shoe in either the downstream or upstream direction and thereby also the distribution of pressure within the press zone. Through the same document, it is also known to alter the position for said pressure resultant force by means of a power device displaceable in the machine direction.

Consequently, all changes of the pressure profile must be done by shifting the configurations of the entire position of the actual power device arrangement in question and/or by adjusting the loads that are loaded against the press shoe by separate transverse rows of power devices, which configurations and/or adjustments first thereafter provide the desired alterations of the pressure profile by a small pivoting in the machine direction of an otherwise entirely fixed press shoe. However, it is desirable that the pressure profile may be set without transferring or adjusting the power device arrangement as an entity, while this is complicated both in a mechanical and control engineering way and which therefore is unfavorable, but which also means an essential change of the actual torque that the support element must endure.

In relation to I-beams, box girders have a higher torsional rigidity but they also have certain disadvantages. For instance, the assembly may become more complicated, which in its turn may make the shoe press construction more expensive. It is therefore desirable to find a shoe press construction that enables the use of an I-beam support element and in which shoe press construction the pressure profile may be changed without any risk for pivoting of said I-beam support element.

For instance, through the European patent application EP-A1-0 345 500 a press is known, in which several power devices are arranged as above, i.e. successively in the machine direction between the press shoe and a fixed support for the power devices, but which power devices each also comprises several press cylinders arranged in a row across the fibrous web and by which the distribution of pressure across the machine direction may be regulated by varying the pressure in each press cylinder across the fibrous web.

It is understood, that when the position of the press shoe is changed in the upstream or downstream direction in relation to a counter roll having a certain radius, a simultaneous and required angular adjustment must occur around the longitudinal axis of the press shoe that adjusts the cooperating sliding surfaces of the press shoe and the counter roll relative each other. The same thing goes for a press device having several rows of power devices arranged successively in the machine direction, in which an angular adjustment of the press shoe is desired in order to achieve an increase or a reduction of the nip pressure profile in the machine direction and which is achieved by the different magnitudes of the pressures which are applied on the press shoe from the downstream and the upstream located row of power devices. However, it is also understood that a limited expansion, displacement, pivoting and/or angular adjustment of the press shoe in relation to a horizontal plane in the cross machine direction is feasible since the power devices are not entirely fixed at the press shoe and the support element. This mobility must, however, be within certain determined limits, or problems with the pressure profile and/or damages or needless wear on the integral construction parts will arise.

Consequently, it is very important, in addition to the absorbing of the frictional forces generated in the machine direction during operation, to guide and support the shoe in all directions so that it only may deviate from its intended position within certain, very precisely determined limits.

Therefore, the shoe press known through EP-A1-0 345 500 comprises a strong support element that is fixedly mounted across the machine direction at the support element of the shoe press roll and downstream of the press nip, and against which support the press shoe is in loose contact for obtaining of the wanted support and guiding of the same.

The European patent application EP-A2-0 933 471 shows an additional example of a known shoe press, which comprises a fixed support that is arranged downstream of the press shoe and across the.cross machine direction for absorbing and preventing unwanted horizontal forces and movements outwards in the machine direction. The shoe press also comprises additional guides and supports, which also are supposed to limit or prevent unwanted movements in the upstream direction and across the machine direction. Consequently, a front guide, which is directed forwardly in the machine direction is arranged in the middle of the press shoe and two side guides are arranged with one guide at each end part of the press shoe. Each side guide has a projection that projects from the press shoe across the machine direction. The front guide is cooperating with the fixed support located downstream for limiting movements across the machine direction and the two projections of the side guides are cooperating with two fixed stops for limiting movements in the upstream direction of the press shoe and for preventing an angular adjustment of the press shoe in relation to an axis across said machine direction, i.e. that one side of the shoe is situated more upstream than that of the opposed side.

Also the shoe press shown in EP-A2-0 933 471 has an entirely fixed support for the press shoe, and therefore also the position of the press shoe is entirely fixed in relation to the counter roll. The change of the pressure profile is done exclusively by changes in or of the position of the power devices so that the press shoe in its turn is pivoted around its own longitudinal axis. No displacement of the press shoe occurs in the horizontal plane, i.e. in the web feed direction.

The alteration of the pressure profile is done by mounting different strips, having varying cross-section dimensions, across the machine direction to the upstream and downstream longitudinal sides of the press shoe and/or of the power device, whereby the position of the power device may be altered in relation to the still fixedly arranged supports and stops by moving the upstream mounted strip from a position along the upstream side of the press shoe to a position at the downstream side of the press shoe and vice versa for the strip mounted downstream. The two strips have different cross-section dimensions, and therefore the power device is moved both in relation to the support element and to the press shoe whereby the pressure profile thus will be changed.

Accordingly, in all the shoe presses described above, the supports and the guides for the press shoe are fixed, i.e. entirely immovable, and all maneuvering operations, i.e. all controlled changes in the position of the press shoe and hence the pressure profile, is effected exclusively by changes in or of the position of the power devices so that the press shoe in its turn is pivoted around its own longitudinal axis. In the horizontal plane, i.e. the feed direction of the web, no displacement of the press shoe is done. As already mentioned above, the displacement of the entire or of essential parts of the power device in relation to the support element and the press shoe enforces an unnecessarily complicated and expensive construction.

Finally, a shoe press is known through U.S. Pat. No. 5,676,799, wherein a movable downstream support has been arranged for the press shoe and in which it is indicated that the pressure profile may be influenced by positioning of the press shoe.

However, the shown shoe press comprises only one guide that is arranged downstream, and therefore only the horizontal forces and movements in the machine direction may be controlled. Furthermore, the stop lacks an accurate and exact arrangement for adjusting its position in the machine direction.

The press devices in the described presses are, in addition to the imperfections during operation mentioned above, also proportionately complicated to manufacture, to install and to dismount at service or when changing press devices.

SUMMARY OF THE INVENTION

The object of the present invention is to provide a press having a substantially improved press device, which press device has guides and supports that functions in a considerably better way than earlier and also in all directions necessary, which is uncomplicated to manufacture having low production costs as a consequence, which is simple to assemble and dismount in case of servicing or changing and which press device works in a satisfying way also when an I-beam support element is being used.

According to the invention, the press is characterized in that the press device further comprises a second guide for the press shoe arranged substantially upstream of the press shoe or at least is functioning from the upstream side of the press shoe and substantially in the machine direction W and which second guide is movable between at least a first. and a second position.

According to additional aspects for a press according to the invention, it is applicable:

that the first guide for the press shoe is arranged in a dismountable and adjustable way and comprises at least one support and at least one spacing member;

that each support and spacing member is manufactured in the form of a profiled rail that extends along the press shoe;

that the support comprises two parts, which consist of a lower assembly part and an upper contact part, against which contact part the press shoe is in contact with its long side facing downstream;

that the support is arranged in a displaceable manner in relation to the support element and to the power device by means of elongated, through-going grooves arranged in the assembly part, which grooves extend parallel to each other in the machine direction;

that the support is screwed tightly but releasably to the support element by means of screws arranged in the grooves;

that the spacing member comprises several different part members having different and predetermined widths for obtaining a predetermined and adjustable position for the upper contact part against the press shoe and thereby also for variation of the position of the press shoe in relation to the integrated power devices;

that the second guide for the press shoe comprises two lateral supports, which are arranged in a dismountable and displaceable way at the cross ends of the press shoe;

that the lateral supports are displaceable in an infinitely variable way by means of fasteners and elongated, through-going grooves, which extend successively in a straight line in the machine direction, between at least two positions which are predetermined and fixed by the fasteners and the grooves;

that each lateral support comprises a lower assembly part for mounting of the lateral support to the support element and an upper contact part having a preferably vertical contact surface facing downstream for an upstream guide of the press shoe;

that the press shoe comprises a fixed projection at each of its two cross ends, and with which two projections the contact parts are arranged to be in contact, each having a contact surface of its own;

that the second guide for the press shoe comprises two lateral supports, which lateral supports are fixed at the cross ends of the press shoe in a dismountable and turnable way by means of fasteners;

that each lateral support comprises a lower assembly part for assembling the lateral support to the support element and two upper contact parts being arranged at different distances from the center of the lateral support;

that the upper contact parts each comprises a preferably vertical contact surface that is facing the other contact surface;

that the press shoe comprises two affixed projections, one at each of its cross ends, and against which projections the contact surface of the most upstream positioned contact part is arranged to bear on for an upstream guide of the press shoe;

that the press shoe comprises an eccentric in the form of an eccentrically, pivotable projection arranged at each of the cross ends of the press shoe;

that the spacing member is arranged in a turnable or pivotable way;

that said power devices comprise a number of press cylinders, which are arranged along the press shoe in a straight line and at a certain distance from each other;

that the press shoe is arranged freely resting onto the upper piston ends of the press cylinders for obtaining said free mobility in all directions;

that the second guide consists of a similar, but reversed, guide as the first guide arranged downstream, and which second guide is arranged in a dismountable and adjustable way at several predetermined and fixed positions against and in relation to the first guide;

that the press device is aligned across the machine direction W;

that the counter element comprises a rotatably journalled counter roll that is substantially parallel with the press device;

that the support element for supporting the press shoe consists of an I-beam having a substantially flat waist;

that the resultant force F of the power device arrangement is arranged to work in alignment with the center plane of the waist; and that the press shoe extends in one single piece across the entire belt and that a friction-absorbing layer of hydraulic fluid having a certain hydrokinetic pressure is arranged between the press shoe and the belt.

The method according to the invention is characterized in that a second guide for the press shoe, which is arranged substantially upstream of the press shoe or at least on the upstream side of the press shoe, is acting substantially in the machine direction W and which second guide is transferred between at least a first and a second position by being dismounted and/or adjusted.

BRIEF DESCRIPTION OF THE DRAWINGS

The invention will be explained in greater detail below with reference to the accompanying figures, wherein.

DETAILED DESCRIPTION OF THE INVENTION

Figure 1:
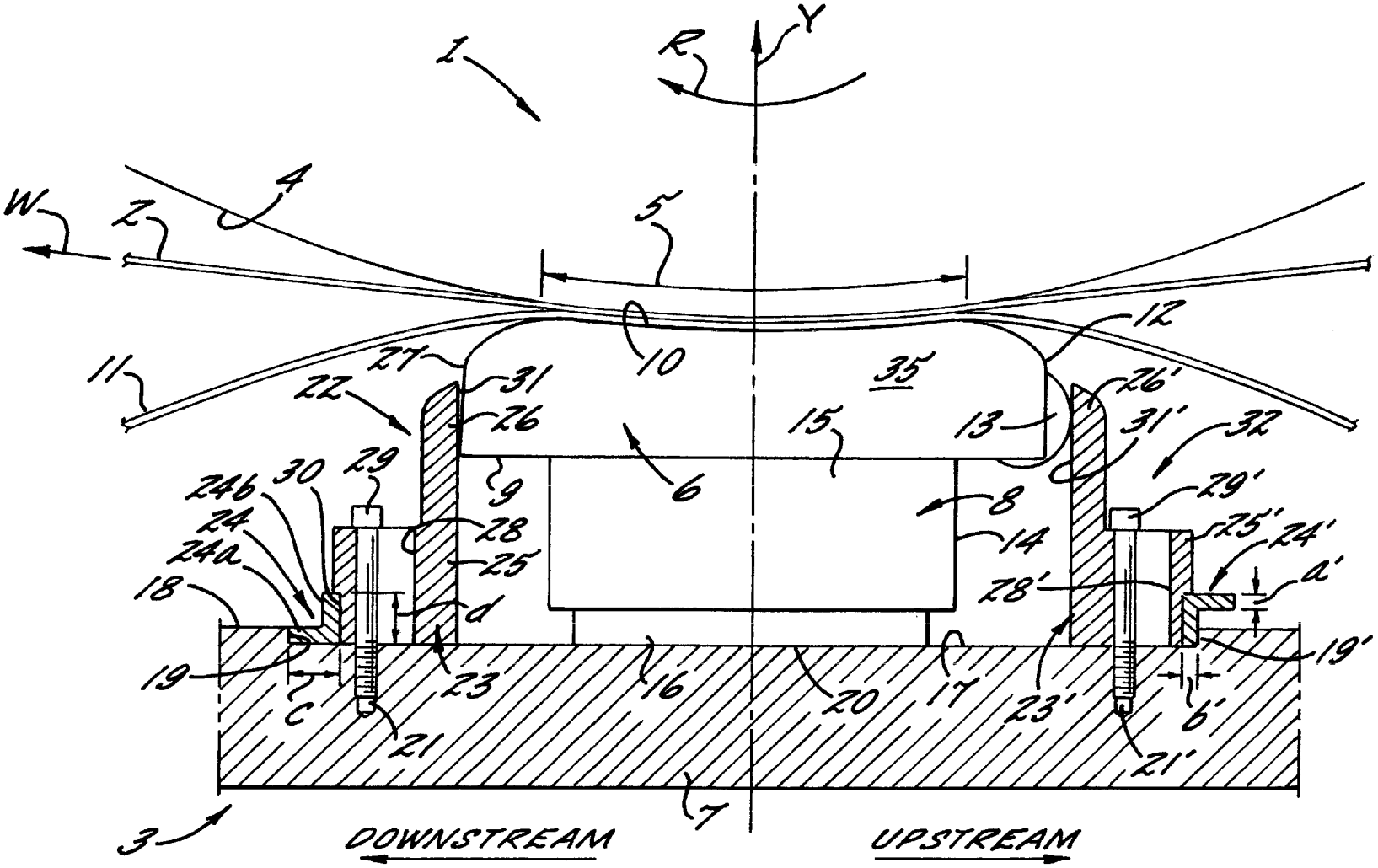
FIG. 1 is a schematic side view and cross-section of parts of a press with an extended press nip according to a first embodiment of the present invention having a press device and a rotatably journalled counter roll opposite to the press device, which press device comprises a press shoe, which is arranged at a first, operative position by means of one upstream and one downstream, adjustable first and second guide for guiding and supporting the press shoe.

With reference to FIG. 1, parts of a press 1 are schematically shown in a side view and cross-section, for instance a wet press or a calender, which is arranged in a machine for the production or treatment of a continuously running web 2 of cellulosic fibrous material, for instance a paper, tissue or board machine, during which production or treatment the fibrous web 2 is, for instance, dewatered by extrusion of water, compressed, surfaced, treated for achieving the correct thickness, etc. The press I comprises a press device 3 and a counter element 4 arranged opposite to the press device 3, which in the embodiments shown in the figures comprises a rotatably journalled counter roll 4 with the rotation direction R. In cooperation with the press device 3, the counter roll 4 is arranged to form a press zone in the form of an extended press nip 5 having a certain width in the machine direction W for pressing the fibrous web 2 during its passage through the press nip 5. The press device 3 comprises a press shoe 6, which is arranged substantially across the fibrous web 2, a support element 7, preferably an I-beam, arranged substantially horizontal for supporting the press shoe 6 and at least one power device 8 arranged between the press shoe 6 and the support element 7 for applying a predetermined pressure against the underside 9 of the press shoe 6 in a direction towards the counter element 4 and thereby also against the fibrous web 2 via the press shoe 6. The press shoe 6 comprises a concave mating surface 10 facing the counter roll 4, which mating surface 10 is provided with a radius that equals the curvature of the counter roll 4. The press device 3 also comprises a flexible and preferably impermeable belt 11 that is arranged to run in a continuous loop around the support element 7 and through the press nip 5 having a sliding contact with the mating surface 10 of the press shoe 6. The impermeable web loop 11 may be attached at each side edge to a rotatable roll head for forming a formable press roll having a flexible mantle (not shown) or be arranged to run over a number of rolls, not shown, and through the press nip 5, wherein the fibrous web 2 is pressed between the web loop 11 and a determined part of the surface of the counter roll 4.

The press shoe 6 comprises a feed conduit 13 for pressurized hydraulic fluid, which is attached along the upstream side 12 of the press shoe 6 and which feed conduit 13 is providing one or more hydrostatic pressure pockets, which are arranged in said mating surface 10 (not shown), via a channel system in the press shoe 6. The function of the hydraulic fluid is to form and maintain a friction absorbing layer between the press shoe 6 and the belt 11, which press shoe 6 preferably extends in one piece across the entire belt 11, at the same time as a hydrokinetic pressure is obtained between them. The power device 8, which preferably is hydraulically or pneumatically driven, is attached to the support element 7 at its lower end part by means of suitable attachment means, as for instance screws (not shown), and is consequently arranged in a stationary way in relation to said support element 7. Simultaneously, the press shoe 6 is, within certain determined limits, arranged in a way that is freely movable in all directions in relation to the same power device 8 and at the upper end part of this, see in more detail below. Preferably, the power device 8 comprises a number of press cylinders 14, which are mounted at a certain distance from each other in at least one linear row along the support element 7, and which press cylinders 14 are fixedly connected to the support element 7 but arranged against the underside 9 of the press shoe 6 in said movable way at its upper end parts. For instance, this can mean that the press cylinders 14 comprise a combination of several part members, at least comprising one cylinder 15 and one piston 16 and where either the cylinder 15 or the piston 16 may be in two parts, in which the integral part members 15, 16 are arranged in a displaceable way in relation to each other in the press direction, but also somewhat tiltable by means of a gap, hence arranged between said part members 15, 16 and possibly also between the press shoe 6 and the upper part member 15, 16, which is joined to the press shoe 6 in a movable way, for instance by a recess, hence arranged in the press shoe 6. Alternately, the press shoe 6 may rest freely onto each upper piston end (not shown) of a press cylinder 14 for obtaining said free mobility in all directions, which piston end may be somewhat roundish or may comprise a bearing. For a closer understanding of this prior art for obtaining a floating support for the press shoe 6 in relation to the support element 7, we refer, for instance, to the documents mentioned above.

A rectangular assembly area 17 in the form of a shallow, flat recess is milled in the top surface 18 of the support element 7 facing the press shoe 6. The assembly area 17, which extends in the longitudinal direction of the support element 7, is limited by two longitudinal edges 19, 19' respectively located at downstream and upstream positions and which edges 19, 19' are parallel to each other, by two transverse edges (not shown) that are parallel to each other, and by a bottom surface 20 that supports the power device(s) 8. Within the assembly area 17, and preferably at equal distances from its edges 19, 19', the power device or the power devices 8 is/are mounted in the way described above. A plurality of threaded holes 21, having a determined and common dividing, are milled within said recess 17 and arranged in one or more linear row/s along, and at a certain distance from, the upstream and/or the downstream located longitudinal edge 19', 19.

A first guide 22 for the press shoe 6 is arranged in a dismountable and adjustable way along the longitudinal edge 19 located downstream. Each such downstream guide 22 comprises at least one support 23 and at least one spacing member 24, which supports 23 and spacing members 24 may each be produced in one elongated piece, each preferably in the form of a profiled rail extending along the entire length of the press shoe 6, but they may also consist of a plurality of parts distributed in the cross-direction. The support 23 comprises two parts, which consist of a lower assembly part 25 and an upper contact part 26, which latter extends from the lower assembly part 25 in a substantially right angle in relation to the support element 7 and against which contact part 26 the press shoe 6 presses with its downstream facing long side 27.

The support 23 is arranged in a displaceable way in relation to the support element 7, to the downstream located longitudinal edge 19 and to the power device 8 by means of elongated, parallel grooves 28 milled through the assembly part 25, which grooves 28 extend in the machine direction and in which grooves 28 screws 29 are tightly but releasably screwed in the threaded holes 21 mentioned above. The spacing member 24, which is turnable or pivotable, is clamped between the downstream located longitudinal edge 19 and the assembly part 25, which latter also comprises a longitudinal recess 30 for said spacing member 24. The spacing member 24 has a cross-section profile, which profile is very precisely sized and comprises several different part members 24*a*, 24*b*, etc., having different and predetermined widths a, b, c, d, etc. for obtaining a very exact, predetermined and adjustable position for the upper contact surface 31 of the contact part 26 against the press shoe 6. The position of the press shoe 6 in relation to the longitudinal edge 19 located downstream, and thereby also in relation to power devices 8, counter elements 4 and vertical central axis Y of the support element 7, may therefore be varied in a simple, effective and very exact way according to the necessary properties for the present press situation. Since the power device arrangement 8, in the press 1 according to the invention, always is fixedly attached and centered to the vertical central axis Y of the support element 7, the pressure resultant force that occurs during the pressing operation will always have a vertical component part along said central axis Y, regardless of which position the press shoe 6 takes, and which vertical component part then does not give any additional torque.

Figure 2:
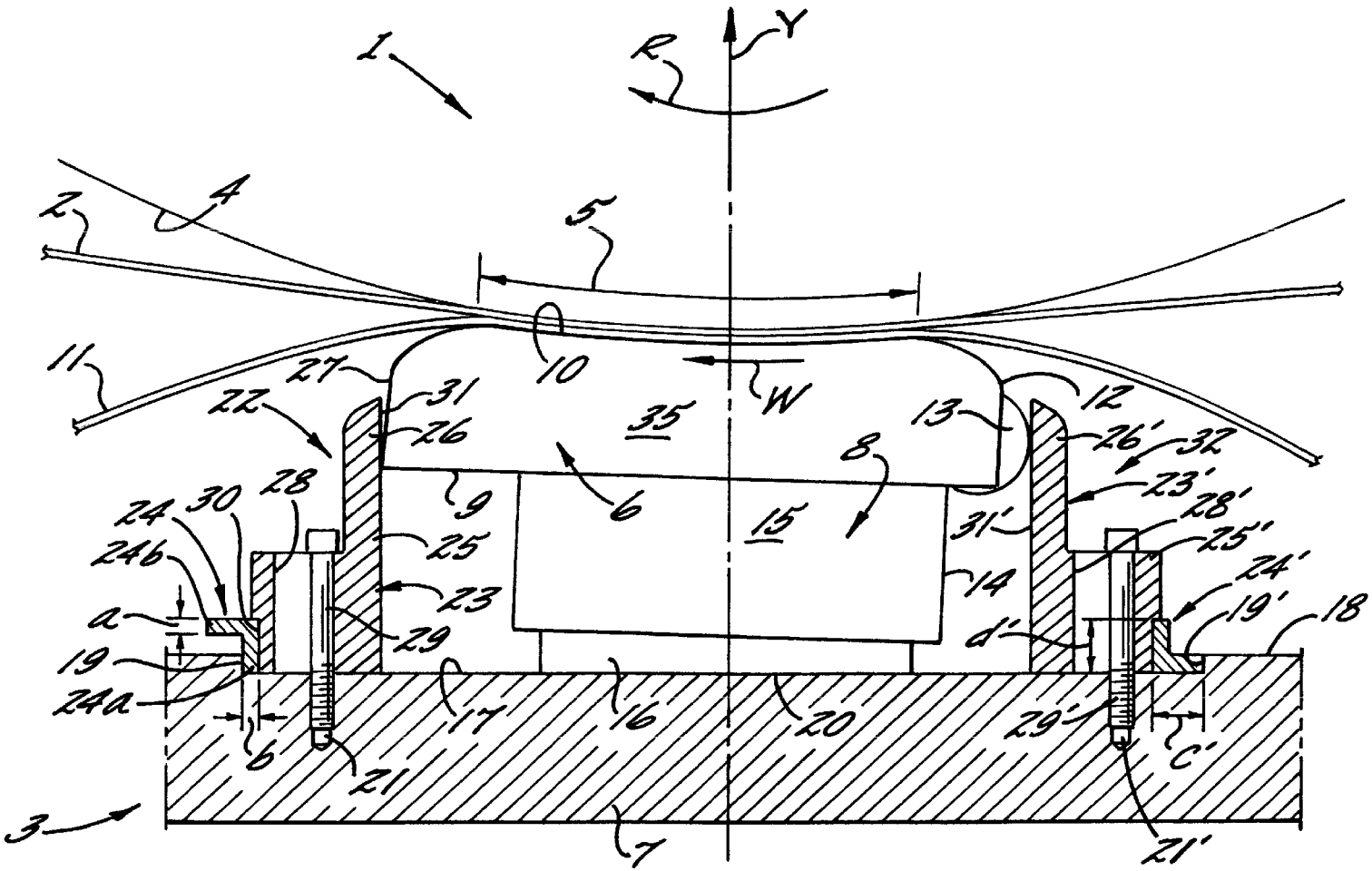
FIG. 2 is a schematic side view and cross-section of the press according to FIG. 1 with the press shoe at a second, operative position.

In addition to the described first guide 22, located downstream, the press device 3 also comprises an additional and second guide 32 for the press shoe 6, which is arranged substantially upstream or at least working from the upstream side and substantially in the machine direction against the press shoe 6. In the embodiment shown in FIGS. 1 and 2, this second guide 32 constitutes of a similar but reversed guide 32 as the first guide 22 arranged downstream and which second guide 32 also is arranged in the same way as the first guide 22, i.e. in a dismountable and adjustable way, at several predetermined, fixed positions against, and in relation to, the upstream, longitudinal edge 19'.

This means that in the case of an upstream or downstream relocation, when the pressure profile needs to be changed, of the first contact surface 31 of the guide 22 and thereby also a relocation of the press shoe 6 to a new position, which is determined of the downstream located spacing member 24, which relocation is achieved by rotating or turning the downstream located spacing member 24 to a new position comprising a new profile width a, b, c, etc. in the machine direction, also the contact surface 31' of the upstream guide 32 is moved equally and in the same direction as for the press shoe 6 and the first contact surface 31 of the guide 22 through an equivalent rotating or a turning of the upstream located spacing member 24'.

Figure 3:
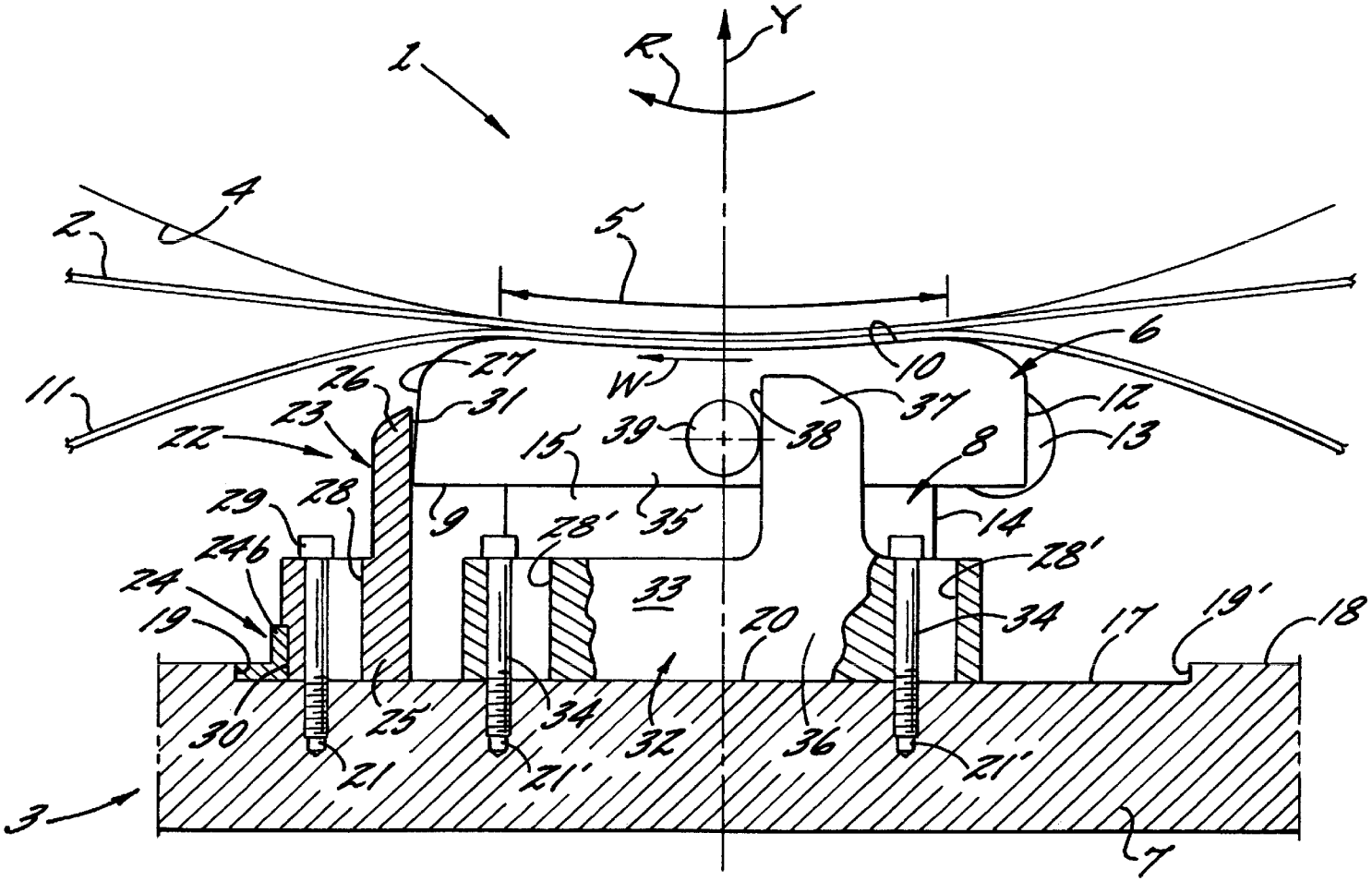
FIG. 3 is a schematic side view and cross-section of parts of a press with an extended press nip according to a second embodiment of the present invention, in which the press shoe is arranged at a first operative position by means of adjustable guides, one downstream and one first and one second guide arranged at each cross end of the press shoe.
Figure 4:
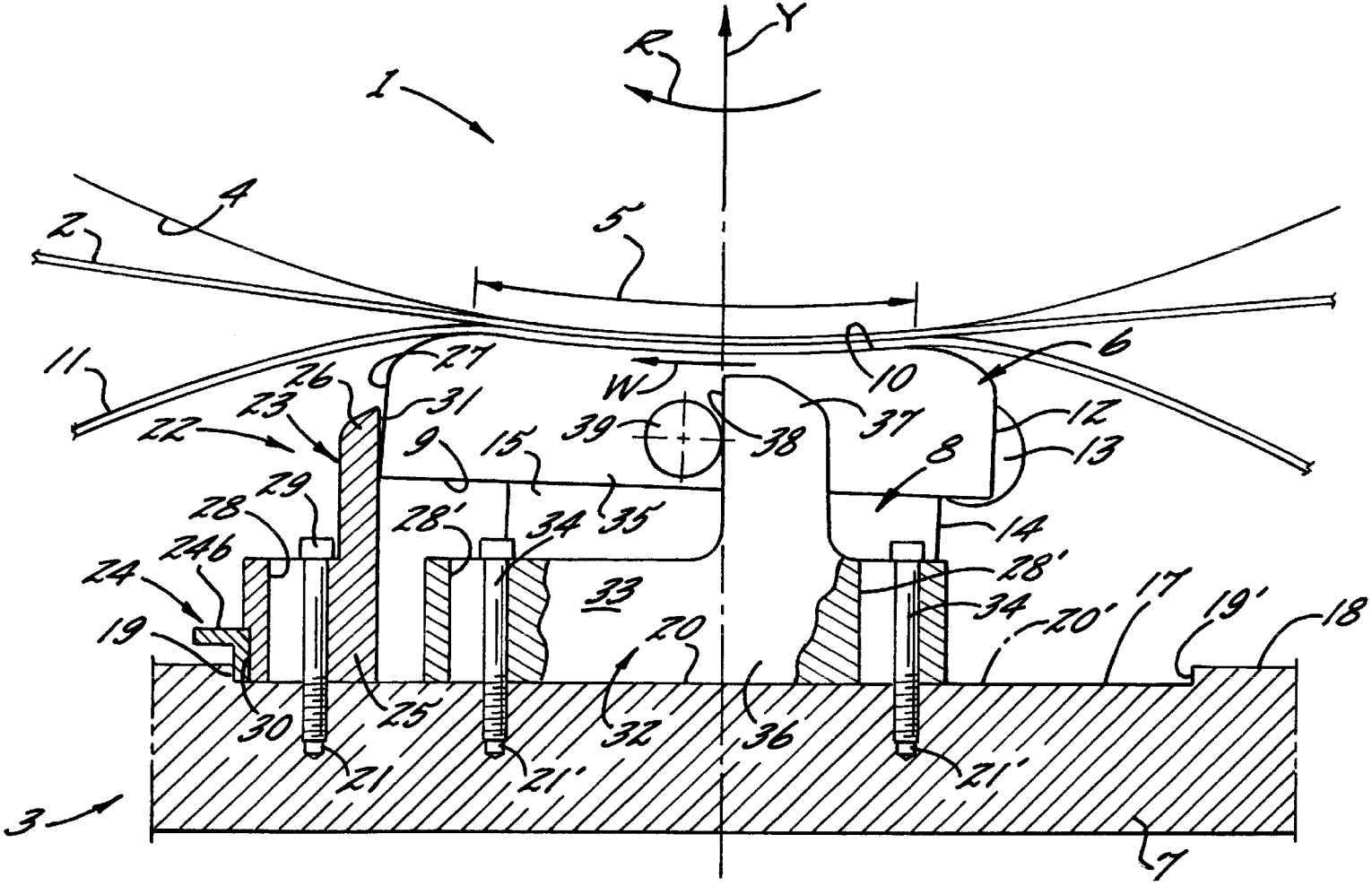
FIG. 4 is a schematic side view and cross-section of the press according to FIG. 3 with the press shoe at a second operative position.

In the second embodiment of the present invention, shown in the FIGS. 3 and 4, the second guide 32 for the press shoe 6 comprises two lateral supports 33, which lateral supports 33 are arranged in a dismountable way at the cross ends 35 of the press shoe 6 by means of fasteners 34, threaded holes 21' and elongated, through grooves 28', which extend in a straight line in the machine direction. Furthermore, the lateral supports 33 are steplessly displaceable along each of the two transverse edges of assembly area 17 between at least two positions, which are predetermined and fixed by the fasteners 34 and the grooves 28'. Each lateral support 33 comprises two parts, which parts consist of a lower assembly part 36 for assembly of the lateral support 33 to the support element 7 and an upper contact part 37. This contact part 37 extends from the lower assembly part 36 at a substantially right angle relative to the support element 7 and comprises a preferably vertical contact surface 38 facing downstream. In this second embodiment of the press 1 according to the invention, the press shoe 6 also comprises a fixed projection 39 at each of its both cross ends 35, against which two projections 39 the contact parts 37 are arranged to abut, each having a contact surface 38 for achieving an upstream guiding of the press shoe 6.

Figure 5:
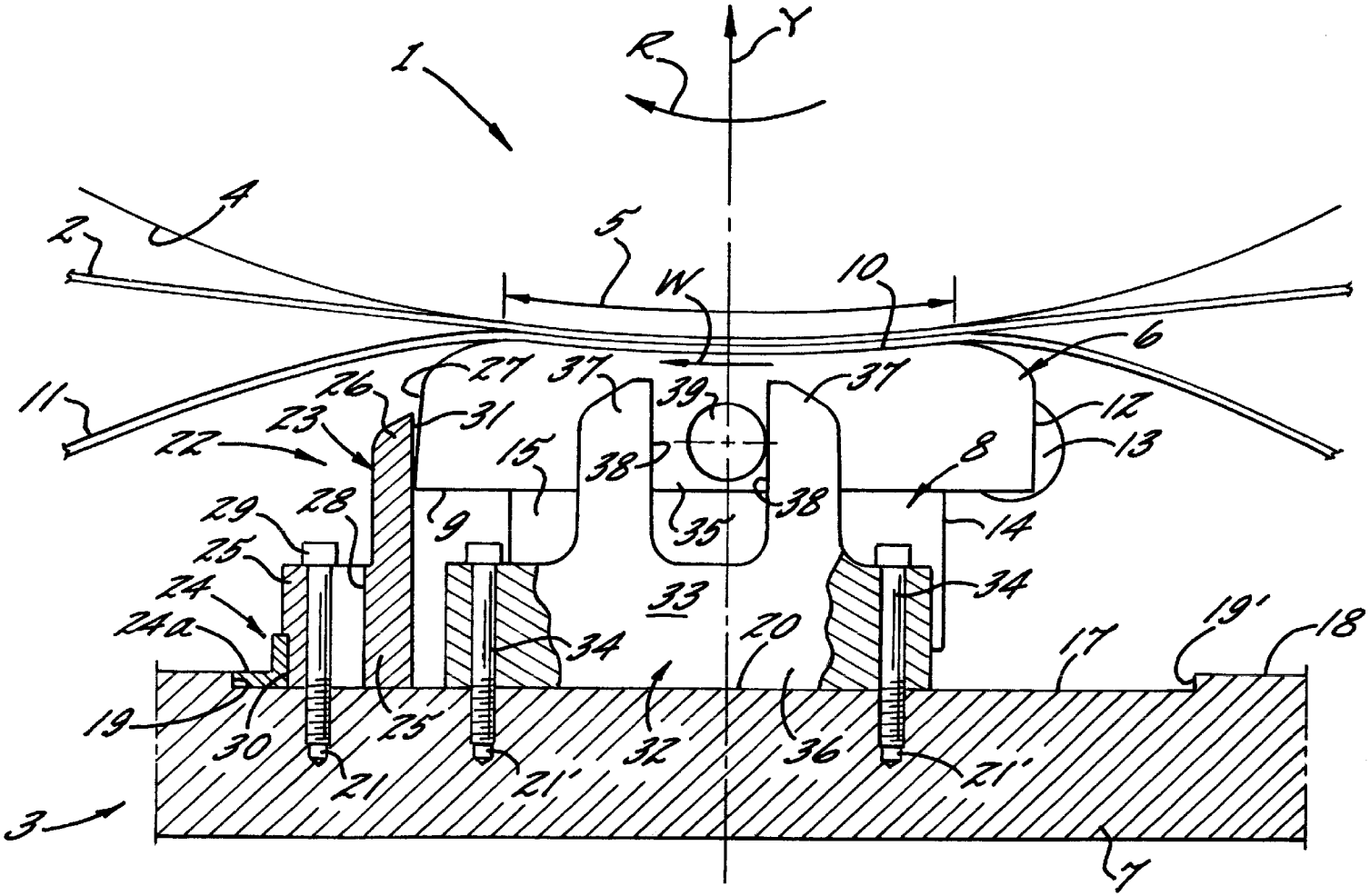
FIG. 5 is a schematic side view and cross-section of parts of a press with an extended press nip according to a third embodiment of the present invention, in which the press shoe is arranged at a first operative position by means of adjustable guides, one downstream and one first and one second guide arranged at each cross end of the press shoe having a somewhat different design.
Figure 6:
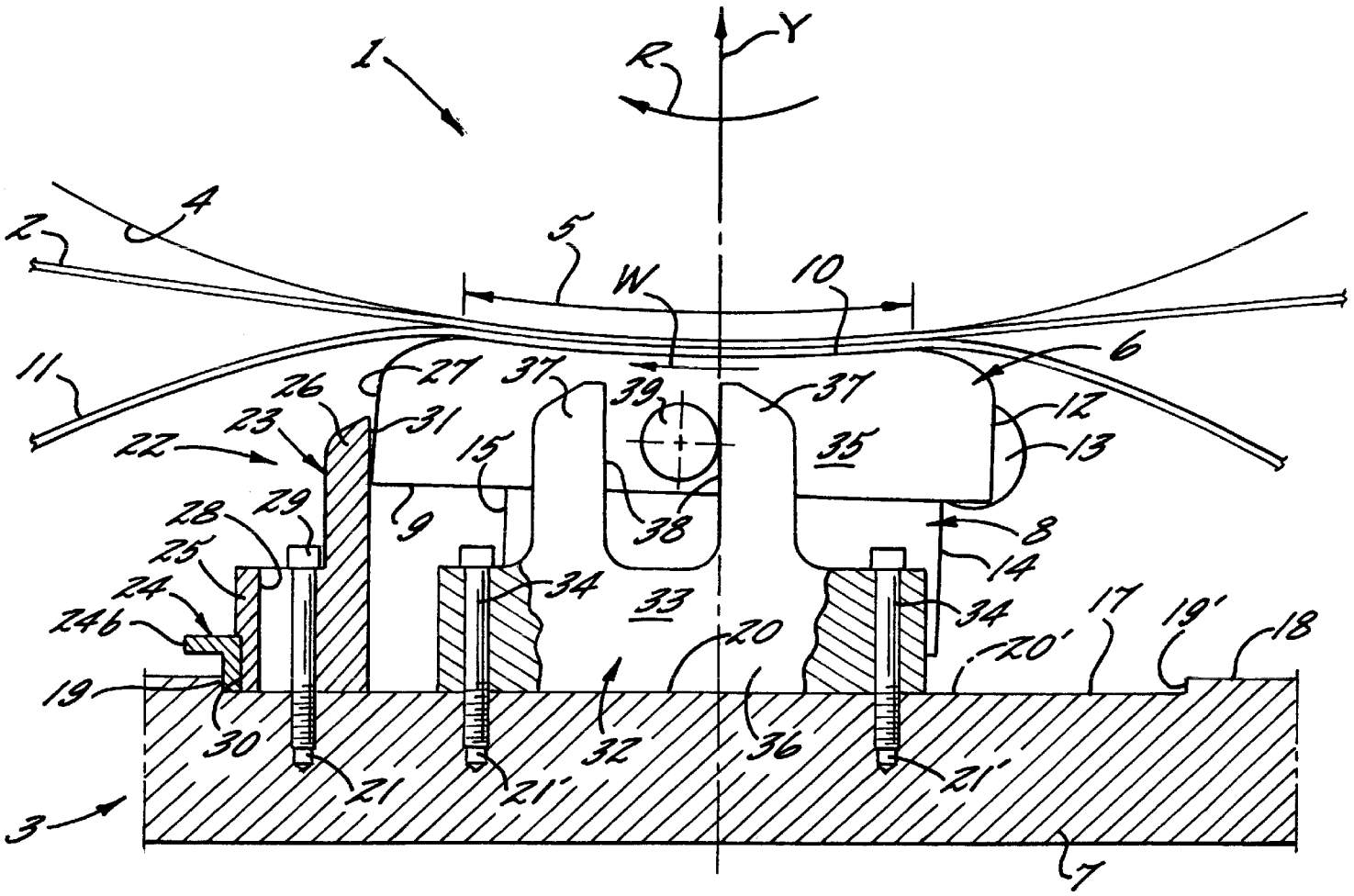
FIG. 6 is a schematic side view and cross-section of the press according to FIG. 5 with the press shoe at a second operative position.

In the third embodiment of the present invention shown in FIGS. 5 and 6, the second guide 32 for the press shoe 6 comprises two lateral supports 33, which lateral supports 33 are attached in a dismountable way by means of fasteners 34 and threaded holes 21 at the cross ends 35 of the press shoe 6 and also arranged in a turnable way along each of the two transverse edges of the assembly area 17. Each lateral support 33 comprises three parts, which parts consist of a lower assembly part 36 for assembly of the lateral support 33 to the support element 7 and two upper contact parts 37, which are arranged at two different distances from the lateral support 33 center. Each of these contact parts 37 extends from the lower assembly part 36 at a substantially right angle relative to the support element 7 and which upper contact parts 37 each comprise a preferably vertical contact surface 38 facing each other. Also in this third embodiment of the press 1 according to the invention, the press shoe 6 comprises two fixed projections 39, one at each of its cross ends 35, and against which projections 39 the contact surface 38 of the most upstream located contact part 37 is arranged to abut for an upstream guiding of the press shoe 6.

Figure 7:
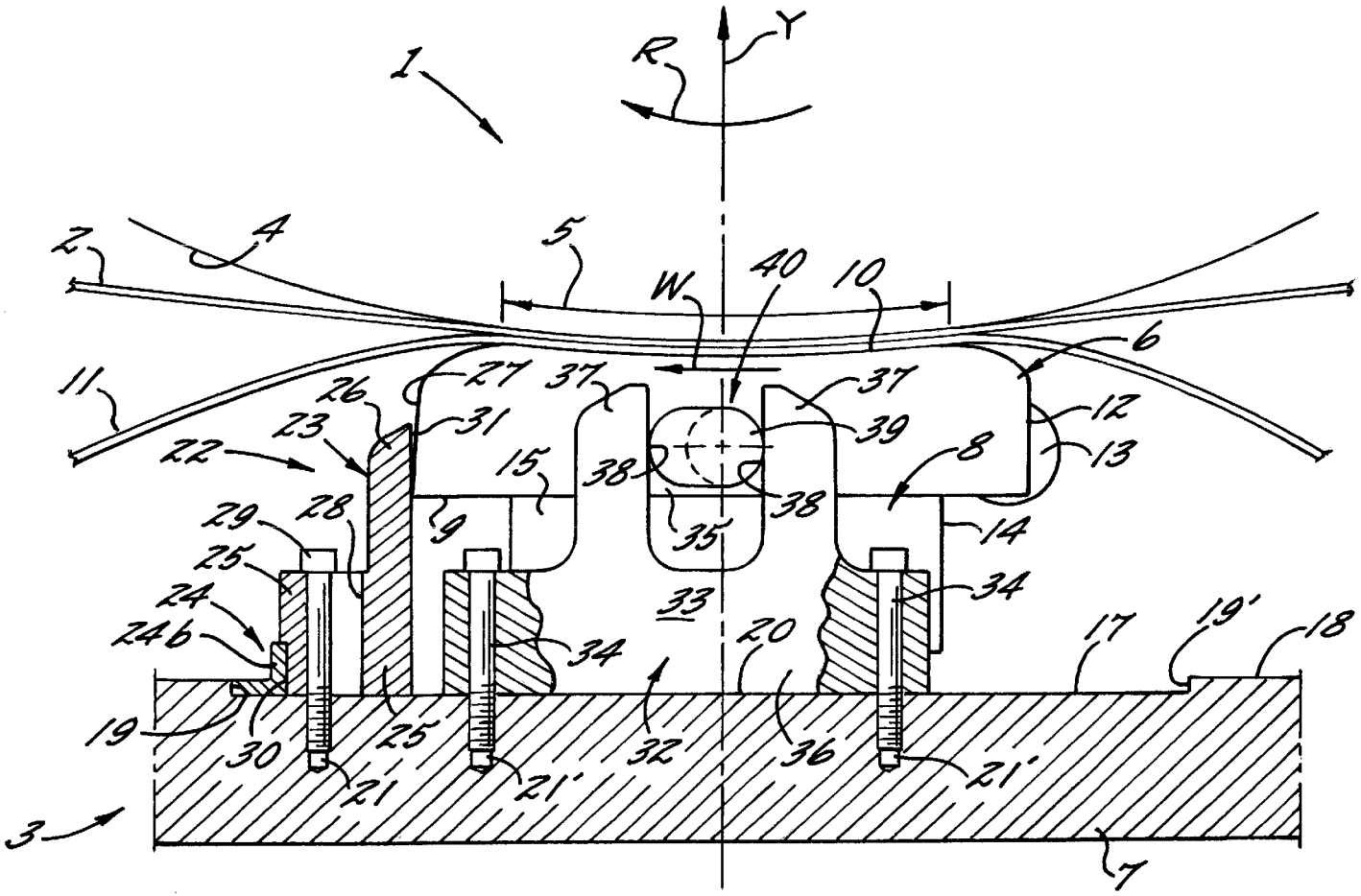
FIG. 7 is a schematic side view and cross-section of parts of a press with an extended press nip according to a fourth embodiment of the present invention, in which the press shoe is arranged at a first operative position by means of adjustable guides, one downstream and one first and one second guide arranged at each cross end of the press shoe, which second guide also comprises an eccentric.
Figure 8:
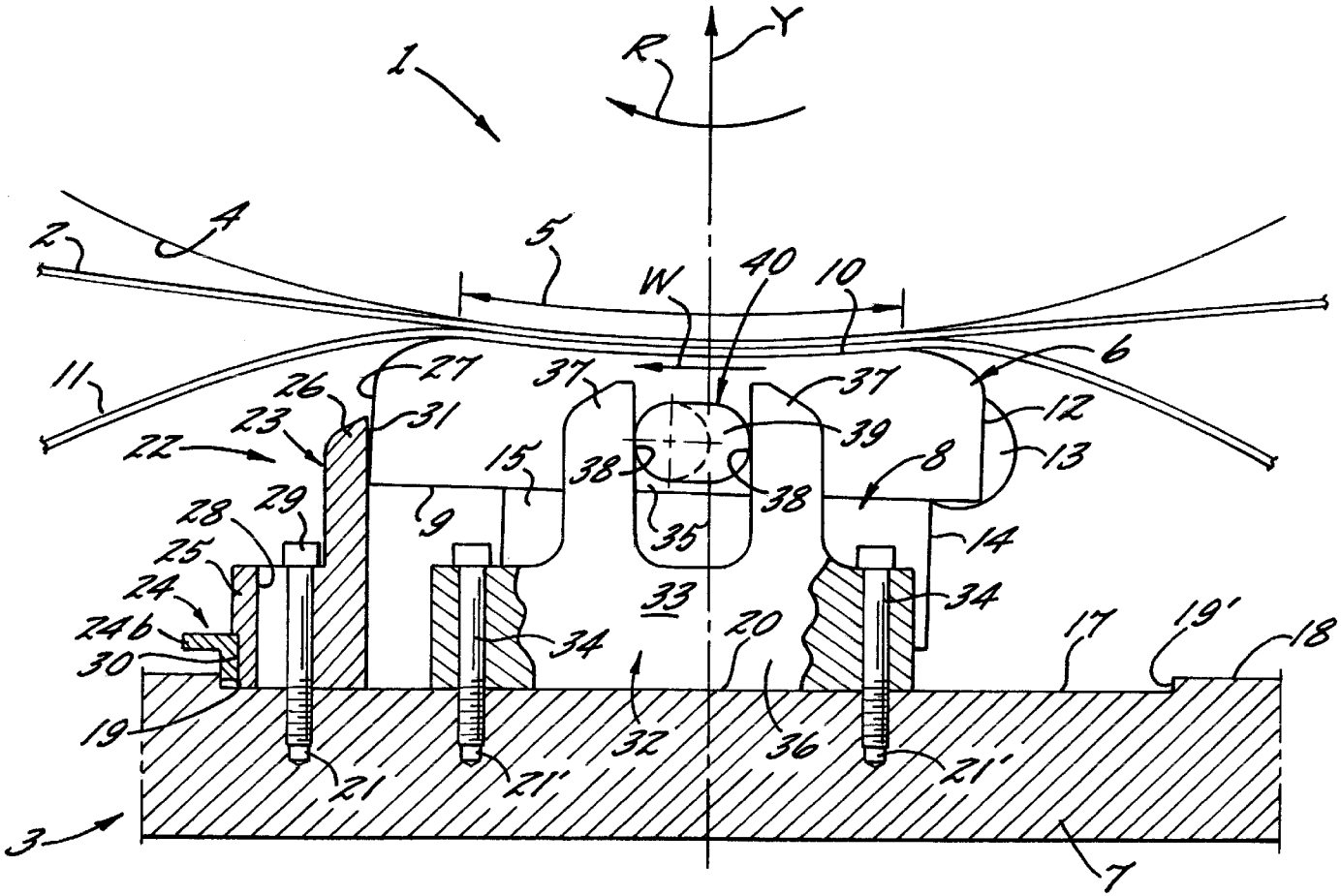
FIG. 8 is a schematic side view and cross-section of the press according to FIG. 7 with the press shoe at a second operative position.

In the fourth embodiment of the press 1 according to the invention, shown in the FIGS. 7 and 8, this press 1 comprises the same component parts, which are arranged in the same way as the third embodiment shown in the FIGS. 5 and 6, except for the difference that the press shoe 6 instead of the fixed projections 39 comprises an eccentric 40 in the form of an eccentrically pivotable projection 39 arranged at each cross end 35 of the press shoe 6.

Figure 9:
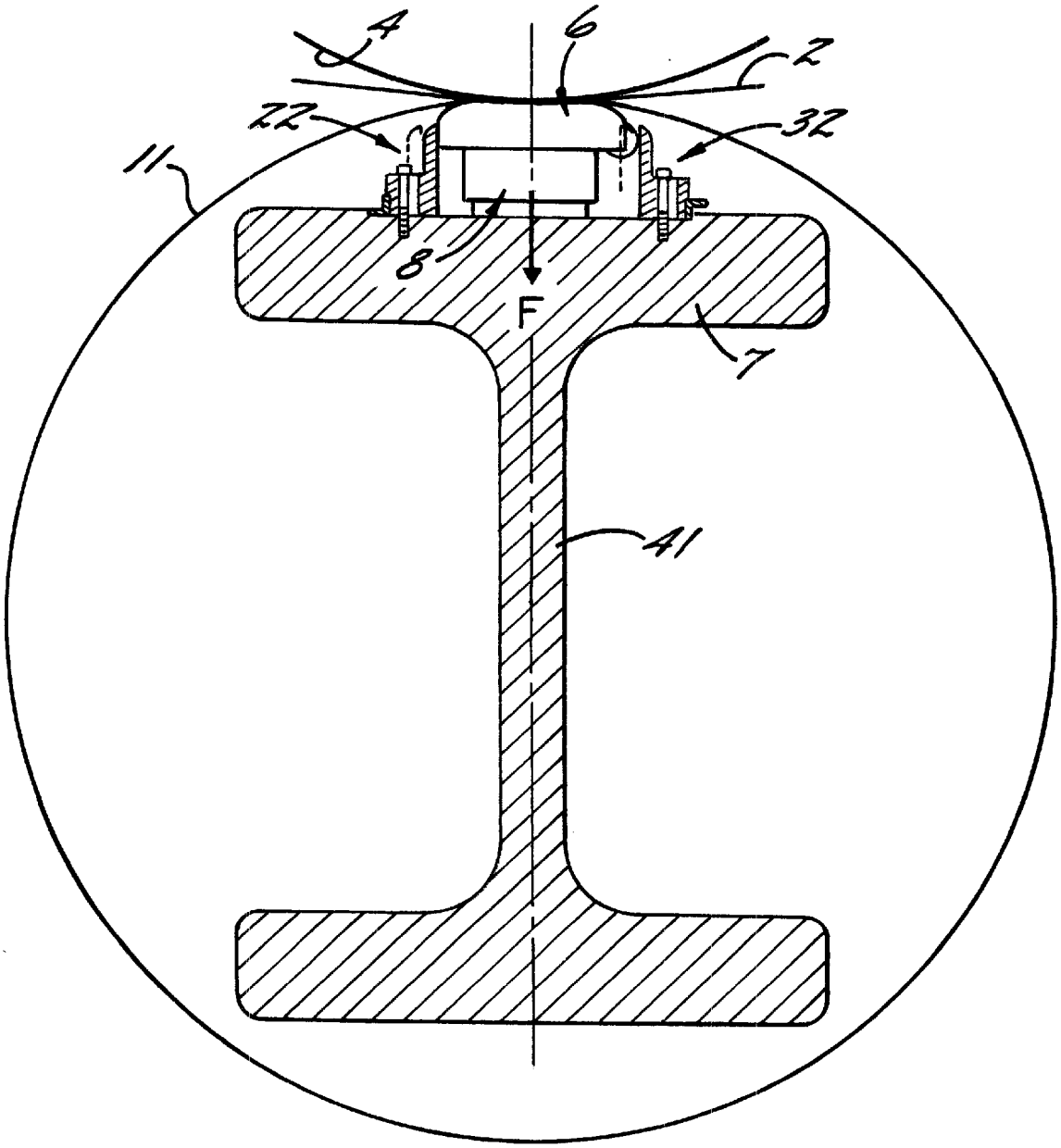
FIG. 9 is a schematic side view of a press according to the invention comprising a support element in the form of an I-beam.

With reference to FIG. 9, a press 1 is shown in a schematic side view comprising a support element 7 in the form of an I-beam. The I-beam has a substantially flat waist 41 and the power device arrangement 8 is arranged to function with its resultant force F in alignment with the center plane of the waist 41 in such a way that regardless of the pressure curve set, the press cylinders 14 still work in alignment with the center plane of the waist 41. This because they are arranged in a symmetric and fixed way relative to the waist 41. Thereby may an adjustable pressure profile be obtained while still using an I-beam.

The function of the press according to the invention is as follows:

When the pressure profile needs to be changed in the press nip 5 between the press shoe 6 and the counter element 4, for instance because of the production of another grade of paper having other characteristics at the pressing, the first and the second guide 22, 32, respectively, working in the downstream and the upstream direction against the press shoe 6, are disengaged from the support element 7. In the embodiment shown in FIGS. 1 and 2, the supports 23 and 23' are then displaced in the grooves 28 so that the contact surfaces 31 and 31' of the guides 22, 32 are moved from a first operative position to a second operative position for the press shoe 6 by placing the spacing member 24, which is located downstream and having a first width c, so that the width b is obtained instead, and simultaneously moving the spacing member 24' located upstream in the same way from a first position having the width b' to a second position having the width c', where the sum b+c'=b'+c. The guides 22, 32 are thereafter once again tightly screwed, after which the position of the press shoe 6 in FIG. 1 thus has been moved somewhat downstream compared with FIG. 2.

In the other embodiments shown, the downstream located guide 22 is moved in the same way as described above, while, for the different embodiments of the second guide 32, this is done in the following way.

In the embodiment shown in FIGS. 3 and 4, each of the lateral supports 33 is loosened so much from the support element 7 that they may be moved in the same direction and as equally much as the downstream located guide 22 has been moved, after which the lateral supports 33 once again are tightened to the support element 7, having a renewed contact against the projection 39 of the press shoe at the new operative position for the press shoe 6.

In the embodiment shown in FIGS. 5 and 6, each of the lateral supports 33 is entirely loosened from the support element 7, turned a half turn, after which the lateral supports 33 once again are tightened to the support element 7, now having a renewed contact against the projection 39 of the press shoe with the earlier, in relation to the first operative position, inactive contact surface 38 of the contact part 37, which, because of the two different distances of the contact parts 37 from the center of the lateral supports 33, equals the accomplished movement of the press shoe 6 by the first guide 22.

In the embodiment shown in FIGS. 7 and 8, the first guide 22 is moved in the same way as described above, while the positions of the lateral supports 33 of the second guide 32 are being retained unaltered. Instead, the eccentric 40 at both cross ends 35 of the press shoe 6 is pivoted to a new position, in which new position. the eccentrically pivotable projection 39 is in afresh contact with the contact surfaces 38 of the lateral support 33 for guiding and supporting the press shoe 6 at the new, and for the press shoe 6, second operative position.

The operative positions of the guides 22, 32 may, of course, be more numerous than the two (first and second) operative positions shown in the figures and they may be achieved in a numerous different ways in addition to the ways shown, having spacing members 24, fasteners 29, 34 and eccentrics 40, for instance by means of guide pins, wedges, eccentrically arranged spacing members etc.

The invention is not limited to the illustrated embodiments, but it may also be varied (not shown) in different ways within the scope of the claims. It is for instance understood that the counter element also may consist of a second press device, preferably a shoe press roll in which the press shoe then is adapted to the press shoe of the first press device so that their sliding surfaces are cooperating in forming a determined press zone there between. The actual press shoe is preferably designed in one piece, while the power device or the power devices preferably comprises/comprise several press cylinders having a preferably even distribution along the press shoe.

It is further realized that one or more, permeable or impermeable clothings, not shown, as smooth or imprinted felts, wires etc., may be arranged to run in a loop of its own across a number of guide rolls and through the press nip together with the fibrous web and the belt. In a wet or impulse press, the said clothings may for instance comprise one or more press felts, which are running trough the nip together with the wet fibrous web while water is being transferred to the press felts when being pressed in the nip. It is also understood, that on the other hand the press may consist of a calender or another finishing unit, in which the then substantially entirely dried fibrous web is surfaced and/or shaped, for instance calendered, imprinted etc. The press according to the invention may also be used for other webs than paper and cardboard, for instance tissue.

Even if the invention is intended for a shoe press having only one row of press cylinders, it may be used in a double-row arrangement. In this case, the power device may then also comprise several, preferably two, mutually parallel rows having several press cylinders in each row across the belt and along the press shoe. The press cylinders may also be divided into groups for variation of the pressure across the press shoe. The fixed edges in the above-described embodiments, which are formed of the lowered assembly area, may, of course, instead consist of edges or other suitable supports mounted on top of the top surface of the support element or projecting from the support element for determining of set baselines from which diverse, nearly exact positions for the press shoe may be set by means of spacing members cooperating in pairs, which together give the selected position for the press shoe.

In alternative embodiments, not shown, the second guide may, in the case it consists of lateral supports, also guide directly or indirectly against the upstream side of the press shoe instead of against the projections mentioned above. As will also be understood, the second guide, instead of the press shoe, may comprise the described projections, and which projections then in turn run in therefore arranged grooves in the press shoe. Furthermore, it is understood that when the actual press shoe is moved upstream or downstream for changing the pressure profile in the press nip, the first and downstream arranged support is moved equally much as the shoe, which then also is the fact for the second guide, which is moved equally much and in the same direction as the first guide.

Instead of movable guides, different sets of guides, having different geometry (length in the machine direction), may be used. The adjustment may then be done by changing one guide by another.

That which is claimed:

1. Press in a machine for the production or treatment of a continuously running web of cellulosic fibrous material, which press comprises a press device and a counter element arranged opposite the press device so as to form a press zone in the form of an extended press nip in cooperation with the press device having a certain width in the machine direction for pressing of the fibrous web as it runs through the press nip, which press device comprises:

a press shoe;

a support element for supporting and pressing the press shoe in a direction towards the counter element via at least one power device arranged between the press shoe and the support element for application of pressure onto the fibrous web during a pressing operation;

a flexible belt that is arranged to run in a continuous loop around the support element and through the press nip, having a sliding contact with the press shoe; and a first guide for the press shoe arranged downstream of the press shoe, which first guide is movable between at least a first position and a second position displaced from said first position in the machine direction;

wherein the press device further comprises a second guide for the press shoe arranged substantially upstream of the press shoe and substantially in the machine direction and which second guide is movable between at least a first position and a second position displaced from said first position in the machine direction, adjustment of the first and second guides from the first positions to the second positions thereof allowing the press shoe to be adjusted in position in the machine direction so as to alter a machine-direction profile of the pressure applied to the web.

2. Press as claimed in claim 1, wherein the first guide for the press shoe is arranged in a dismountable and adjustable way and comprises at least one support and at least one spacing member.

3. Press as claimed in claim 2, wherein each support and spacing member are manufactured in the form of a profiled rail that extends along the press shoe.

4. Press as claimed in claim 2, wherein the support comprises a lower assembly part and an upper contact part, against which contact part the press shoe is in contact at a long side of the press shoe that faces downstream.

5. Press as claimed in claim 4, wherein the support is arranged in a displaceable manner in relation to the support element and to the power device by means of elongated, through-going grooves arranged in the assembly part, which grooves extend parallel to each other in the machine direction.

6. Press as claimed in claim 5, wherein the support is screwed tightly but releasably to the support element by means of screws arranged in the grooves.

7. Press as claimed in claims 4, wherein the spacing member comprises several different part members having different and predetermined widths for obtaining a predetermined and adjustable position for the upper contact part against the press shoe and thereby also for variation of the position of the press shoe in relation to the power device.

8. Press as claimed in claim 1, wherein the second guide for the press shoe comprises two lateral supports, which are arranged in a dismountable and displaceable way at opposite cross ends of the press shoe.

9. Press as claimed in claim 8, wherein the lateral supports are displaceable in an infinitely variable way by means of fasteners and elongated, through-going grooves that extend successively in a straight line in the machine direction, between at least two positions which are predetermined and fixed by the fasteners and the grooves.

10. Press according to claim 8, wherein each lateral support comprises a lower assembly part for mounting of the lateral support to the support element and an upper contact part having a contact surface facing downstream for an upstream guiding of the press shoe.

11. Press as claimed in claim 10, wherein the press shoe comprises a fixed projection at each of two opposite cross ends of the press shoe, and against which two projections the contact parts are arranged to be in contact, each contact part having a contact surface.

12. Press according to claim 1, wherein the second guide for the press shoe comprises two lateral supports, which lateral supports are fixed at opposite cross ends of the press shoe in a dismountable and turnable way by means of fasteners.

13. Press as claimed in claim 12, wherein each lateral support comprises a lower assembly part for assembling the lateral support to the support element and two upper contact parts being arranged at different distances from a center of the lateral support.

14. Press as claimed in claim 13, wherein each upper contact part of each lateral support comprises a contact surface that is facing a contact surface of the other upper contact part.

15. Press as claimed in claim 14, wherein the press shoe comprises two affixed projections one at each cross end thereof, and against which projections the contact surface of a most upstream positioned one of the contact parts is arranged to abut for an upstream guiding of the press shoe.

16. Press as claimed in claim 1, wherein the press shoe comprises an eccentric in the form of an eccentrically pivotable projection arranged at each of two opposite cross ends of the press shoe.

17. Press as claimed in claim 2, wherein the spacing member is arranged in a turnable or pivotable way.

18. Press as claimed in claim 1, wherein said at least one power device comprise a plurality of press cylinders arranged along the press shoe in a straight line and spaced apart from each other.

19. Press as claimed in claim 18, wherein the press shoe is arranged freely resting onto upper piston ends of the press cylinders such that the press shoe has substantially free mobility in all directions.

20. Press as claimed in claim 1, wherein the second guide is substantially similar to but reversed relative to the first guide, and which second guide is arranged in a dismountable and adjustable way at several predetermined and fixed positions against and in relation to the first guide.

21. Press as claimed in claim 1, wherein the press device extends across the machine direction.

22. Press as claimed in claim 1, wherein the counter element comprises a rotatably journalled counter roll that is substantially parallel with the press device.

23. Press as claimed in claim 1, wherein the support element for supporting the press shoe comprises an I-beam having a substantially flat waist.

24. Press as claimed in claim 23, wherein a resultant force F of the at least one power device is arranged to act in alignment with a center plane of the waist.

25. Press as claimed in claim 1, wherein the press shoe extends in one single piece across the entire belt in a cross-machine direction thereof and wherein a friction absorbing layer of hydraulic fluid having a predetermined hydrokinetic pressure is arranged between the press shoe and the belt.

26. Press as claimed in claim 1, wherein each of the first and second guides includes a spacing member that sets the machine-direction position of the guide and that has two different machine-direction dimensions in two different orientations of the spacing member, each spacing member being mountable on the support element in a selected one of said two different orientations such that the respective guide is positioned in one of the first and second positions thereof by mounting the spacing member in one of said orientations, and is positioned in the other of the first and second positions by mounting the spacing member in the other of said orientations.

27. Method for altering the pressure profile in a press in a machine in which a continuously running web of cellulosic fibrous material is produced or is treated, which press comprises a press device and a counter element arranged opposite the press device, which in cooperation with the press device -forms a press zone in the form of an extended press nip having a certain width in the machine direction so that a pressing of the fibrous web occurs during passage of the web through the press nip, which press device comprises a press shoe;

a support element that supports and presses the press shoe in a direction towards the counter element via at least one power device which is arranged between the press shoe and the support element and which power device is applying a certain pressure onto the fibrous web during a pressing operation;

a flexible and preferably impermeable belt that runs in a continuous loop around the support element and through the press nip having a sliding contact with the press shoe, and a first guide for the press shoe arranged downstream of the press shoe and which first guide is adjustable between at least a first position and a second position displaced from the first position in the machine direction, and a second guide for the press shoe arranged substantially upstream of the press shoe and adjustable between at least a first position and a second position displaced from said first position in the machine direction; the method comprising:

adjusting each of the first and second guides from one of the first and second positions to the other of the first and second positions thereof, thereby allowing the position of the press shoe in the machine direction to be adjusted so as to alter the pressure profile in the press nip.

* * * * *